US006094932A

United States Patent [19]

Chiappetta

[11] Patent Number: 6,094,932

[45] Date of Patent: Aug. 1, 2000

[54] REFRIGERATOR AIR FLOW DIFFUSER ASSEMBLY

[75] Inventor: Donald Chiappetta, Kitchener, Canada

[73] Assignee: Camco Inc., Mississauga, Canada

[21] Appl. No.: 09/238,441

[22] Filed: Jan. 28, 1999

[51] Int. Cl.[7] ..... F25D 17/04

[52] U.S. Cl. ..... 62/408; 239/128; 239/540

[58] Field of Search ..... 62/407, 408, 409, 62/410, 411, 412, 454, 455; 239/128, 540

[56] References Cited

U.S. PATENT DOCUMENTS

| | | | |
|---|---|---|---|
| 3,093,981 | 6/1963 | O'Grady | 62/408 |
| 3,403,533 | 10/1968 | Bollenbacher | 62/408 |
| 3,659,432 | 5/1972 | Selhost | 62/427 |
| 3,908,392 | 9/1975 | Schumacher | 62/180 |
| 4,229,945 | 10/1980 | Griffin et al. | 62/229 |
| 4,614,092 | 9/1986 | Kim et al. | 62/408 |
| 4,768,353 | 9/1988 | Bushser | 62/408 |
| 4,920,758 | 5/1990 | Janke et al. | 62/187 |
| 5,092,137 | 3/1992 | Elsom | 62/408 |
| 5,097,675 | 3/1992 | Elsom et al. | 62/408 |
| 5,191,774 | 3/1993 | Park | 62/408 |
| 5,642,628 | 7/1997 | Wipple, III et al. | 62/186 |
| 5,802,867 | 9/1998 | Kang | 62/408 |

*Primary Examiner*—Henry Bennett
*Assistant Examiner*—Malik N. Drake

[57] ABSTRACT

A diffuser assembly for controlling air flow in a fresh food compartment of a refrigerator has a housing mounted to the refrigerator liner wall that covers a first air flow opening in the fresh food compartment liner. The housing has side walls and an exterior wall with a second air flow opening spaced from the liner by the side walls. An air flow passage extends between the first air flow opening and a second air flow opening The exterior wall has a first centralized opening passing therethrough and an inner surface with a recessed elongated slot. The assembly has an elongate leaf spring secured in the housing adjacent the inner surface along the recessed slot and biased away from the exterior wall. The spring has a second centralized opening aligned with the first centralized opening. The assembly has a dial diffuser with a shaft that extends through the first and second centralized openings and a shaft controlling portion extending beyond the exterior wall of the housing. The dial diffuser has a substantially circular disk shaped damper drawn against the leaf spring. The damper has a cut out portion and is rotatable to control coverage area of the first air flow opening in the liner and control air flow through the housing. A locking member is secured to the shaft extension adjacent to and in pressing relation with the exterior wall of the housing to hold the shaft under tension with the disc damper pulled against the biased leaf spring.

16 Claims, 4 Drawing Sheets

REFRIGERATOR AIR FLOW DIFFUSER ASSEMBLY

FIELD OF THE INVENTION

This invention relates to a diffuser assembly for use in a refrigerator, and in particular a diffuser assembly mounted to a real wall of a refrigerator.

BACKGROUND OF THE INVENTION

In a refrigerator it is common practice to control the air flow into the freezer and fresh food compartment by the placement of a diffuser over an opening in the fresh food compartment. Air flow in the refrigerator typically includes a first air flow path through the freezer compartment and over and evaporator that chills the air. A second air flow path moves through the fresh food compartment and over the evaporator. Air flow through the second air flow path is usually restricted by a diffuser placed across an opening into the fresh food compartment. The diffuser provides resistance to the second air flow path which results in a greater amount of the chilled air passing over the evaporator being directed into the freezer compartment.

There are presently many forms of diffuser assemblies in existence including a diffuser that operates on a principle of rotating a dial across the opening of the refrigerator liner wall to control be air flow resistance out of the opening. The problem with this dial type diffuser is that it is difficult to maintain a tension force on a user control knob to prevent a dial from shifting or rotating on its own. There is a need for a diffuser assembly for use in a refrigerator that maintains the diffuser dial under tension so that it does not rotate relative to the refrigerator opening during operation and is still able to be rotated by a user. In particular there is a need for a dial type diffuser where the tension on the dial is maintained within the diffuser housing without placing undue continued stresses on the liner wall of the refrigerator to which the diffuser assembly is mounted.

SUMMARY OF THE INVENTION

The present invention is directed a diffuser assembly for use in a refrigerator. The diffuser assembly is mounted to a liner wall of the refrigerator and tension is maintained on the diffuser damper dial through the co-operation of a leaf spring secured on one side of an exterior wall of the housing, to bias the damper towards the liner, and a shaft locking member secured to the shaft of the damper that extends through the housing, to pull the damper against the leaf spring. The co-operation of the leaf spring and the locking member introduces a stiffness to the rotation of the damper dial which prevents the damper dial from slipping during normal refrigerator operation and that the same time does not place a tension or strain against the refrigerator liner surface of the fresh food compartment.

In accordance with an aspect of the present invention there is provided a diffuser assembly for use in a refrigerator having a liner wall with a first air flow opening therein. The diffuser assembly comprises a housing mounted to the liner wall and covering the first air flow opening. The housing includes side walls and an exterior wall having a second air flow opening spaced from the liner wall by the side walls. An air flow passage extends through the housing between the first air flow opening and a second air flow opening for communicating air flow from the liner opening to the second air flow opening and into the refrigerator. The exterior wall of the housing has a first centralized opening passing therethrough. The assembly includes an elongate leaf spring secured in the housing adjacent the inner surface of the exterior wall for providing a spring bias away from the exterior wall. The leaf spring includes a second centralized opening aligned with the first centralized opening of the exterior wall. The assembly has a dial diffuser having an elongate shaft extending through the first and second centralized openings with a shaft controlling portion extending beyond the exterior wall of the housing. The dial diffuser has a substantially circular disk shaped damper drawn against the leaf spring. The damper has a cut out portion and is rotatable with the shaft to control coverage area of the first air flow opening in the liner and control air flow through the housing. The assembly has a locking member secured to the shaft extension portion adjacent to and in pressing relation with the exterior wall of the housing to hold the shaft under tension with the disc damper pulled against the biased leaf spring.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
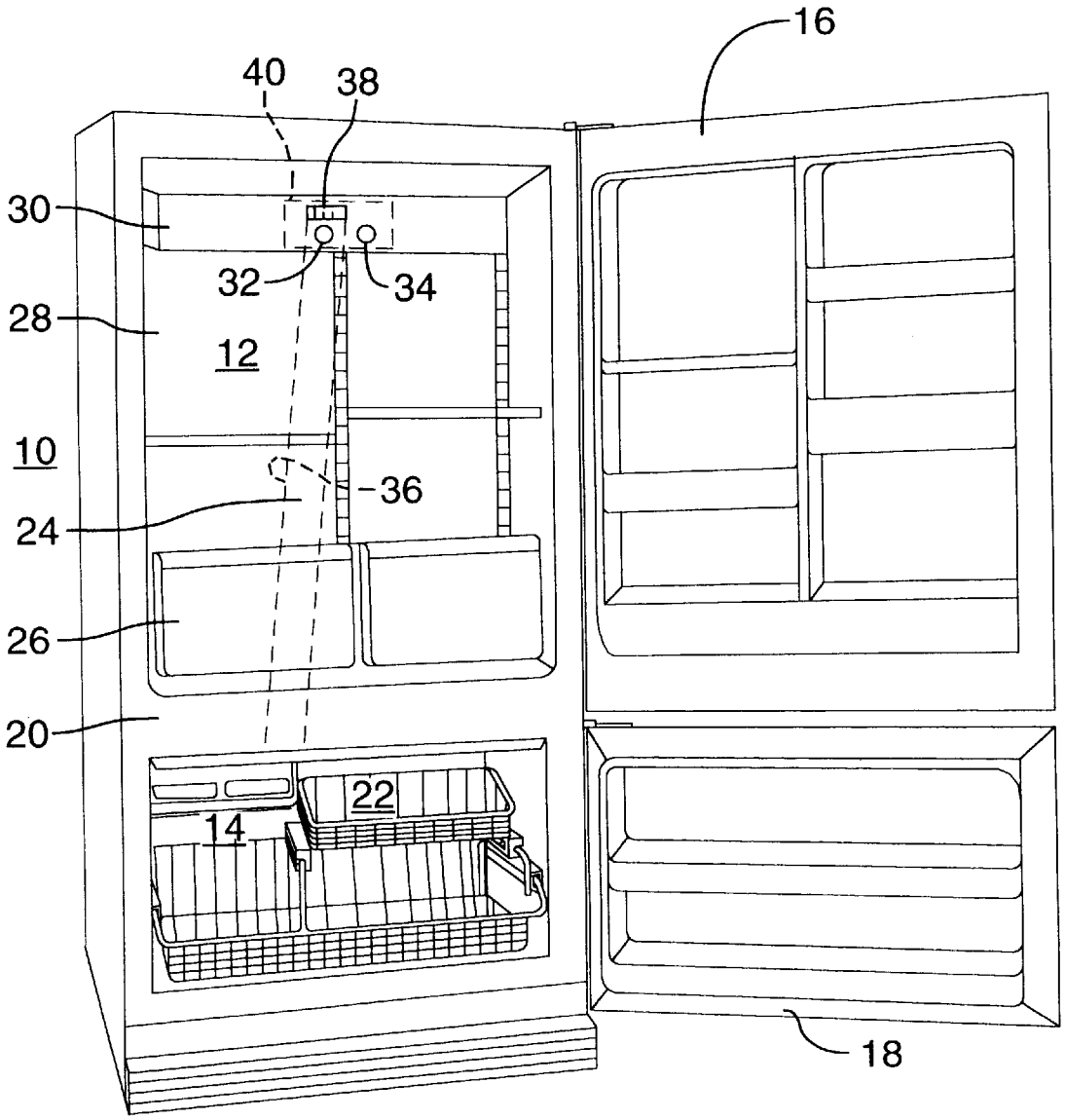
FIG. 1 is a front view of a bottom mount refrigerator showing the general location of the diffuser assembly on the rear wall of the refrigerator liner.
Figure 2:
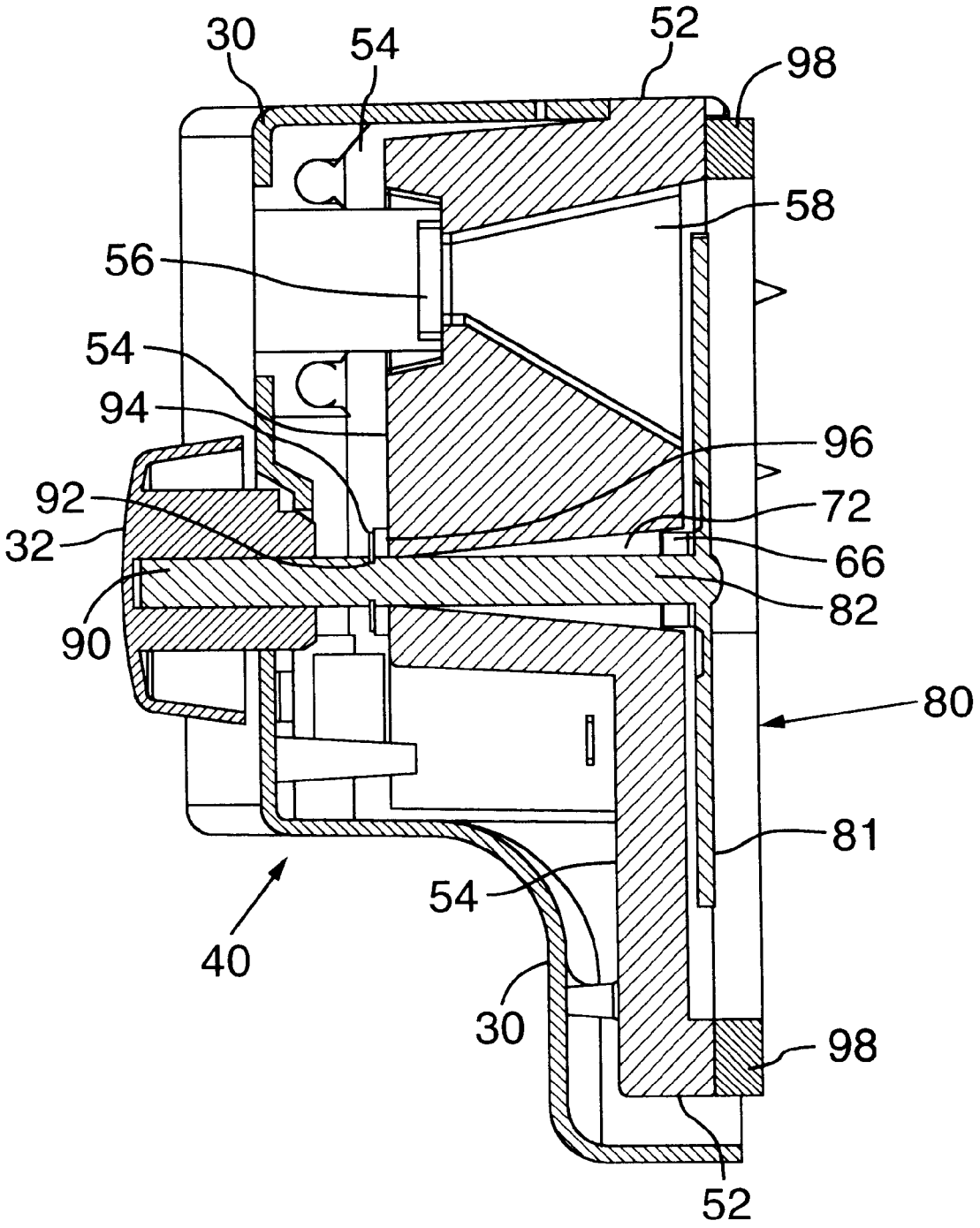
FIG. 2 is a side sectional view of the diffuser assembly of the present invention.
Figure 3:
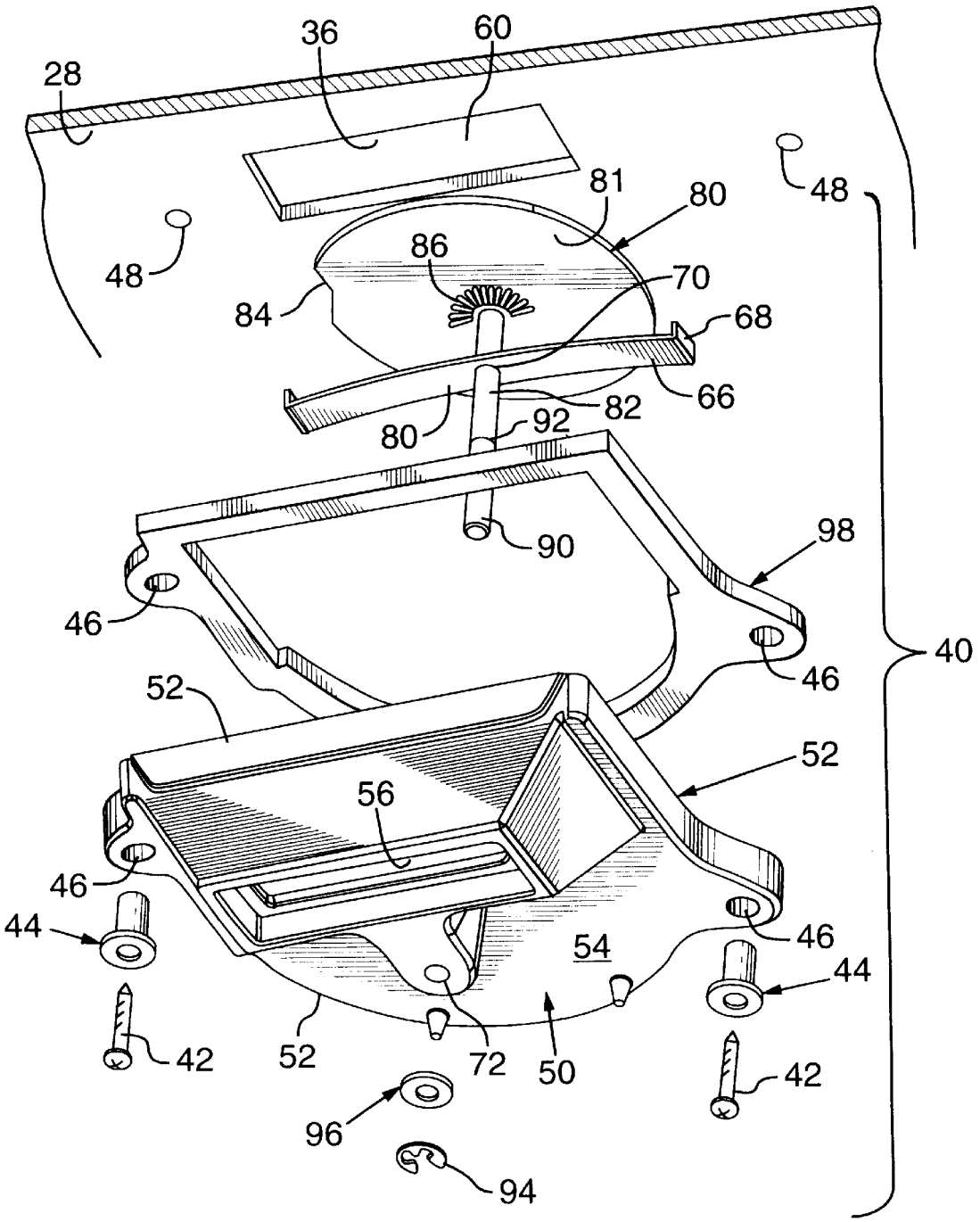
FIG. 3 is an exploded front view of the diffuser assembly of the present invention shown relative to its mounting to the rear liner wall of the refrigerator.

Referring to FIG. 1 there is shown a refrigerator 10, commonly referred to as a bottom mounted refrigerator, having a diffuser assembly 40. The preferred use of the diffuser assembly 40 of the present invention is in respect of a bottom mount refrigerator. It should be understood that the diffuser assembly of the present invention might be used in other types of refrigerators such as, for example, top mount or side-by-side refrigerators. The refrigerator 10 includes an upper food compartment 12 and a lower freezer food compartment 14. The upper fresh food compartment 14 is closed by upper door 16 and the lower freezer compartment 14 is closed by lower door 18. An evaporator, not shown, may be located either in the mullion partition 20 between the upper fresh food compartment 12 and the lower freezer compartment 14, or, alternatively the evaporator may be located behind the rear wall of the freezer compartment 14. Located within the freezer compartment 14 are pull-out shelves 22. The upper food compartment is provided with racks 24 for supporting bins 26. It should be understood that the shelves or bins 26 maybe supported by other suitable means.

The upper food compartment 12 has an interior liner rear wall 28 on which the diffuser assembly 40 and a control panel cover 30 are mounted. The liner rear wall 28 is a steel liner and may alternatively be a plastic liner. The control panel 30 includes lighting and temperature control thermostats, not shown. At the center of the panel cover 30 are two control knobs 32 and 34. Knob 34 is connected to a thermostat and can turn the compressor in the refrigerator on or off. Knob 32 is accessible to a user and is connected to the diffuser assembly 40 to control the flow of chilled air rising from air flow passage 36 (shown in broken line) from the evaporator and into the fresh food compartment 12. Air passage 36 is a closed in passage extending behind the rear liner 28 of the fresh food compartment 12. The air entering food compartment 12 enters through vents 38. The vent openings 38 and the knob 32 form part of the diffuser assembly of the present invention.

Referring now to FIGS. 2 through 5 the diffuser assembly is shown at 40. The diffuser assembly 40 is mounted to the rear wall 28 of the refrigerator by means of threaded screws 42 passing through bushings 44, openings 46, and into opening 48 in the rear liner wall 28.

The diffuser assembly 40 includes a housing 50, having side walls 52 and an exterior wall 54. The exterior wall 54 includes a air flow opening 56 and an air flow passage 58 that extends to be air flow opening 60 in the rear liner wall 28. The flow opening 56 of the exterior wall 54 are spaced from the liner rear wall 28 by the side walls 52 of the housing 50. The exterior wall 54 of the housing 50 further includes a central or centralized opening 72 that is tapering (see FIG. 2).

Figure 4:
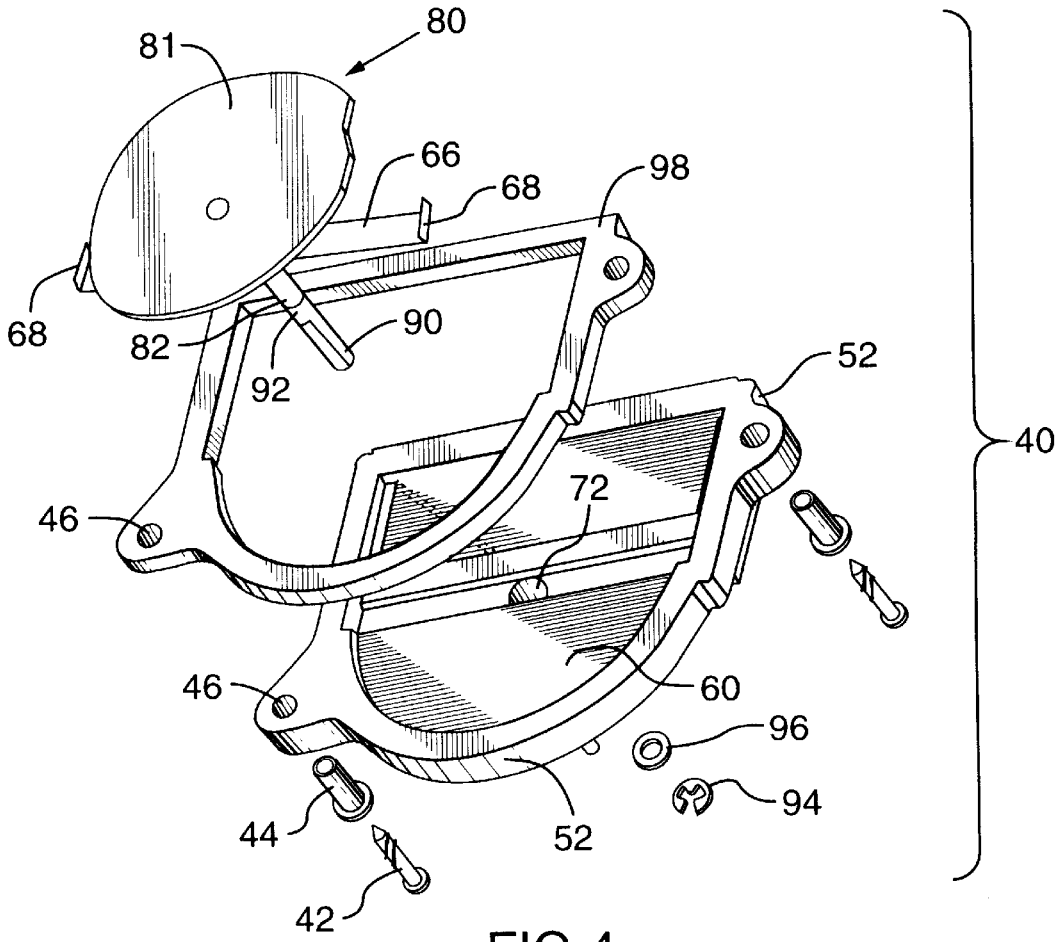
FIG. 4 is an exploded rear view of the diffuser assembly of the present invention; and, FIG. 5 is a rear perspective view of the diffuser assembly of the present invention.
Figure 5:
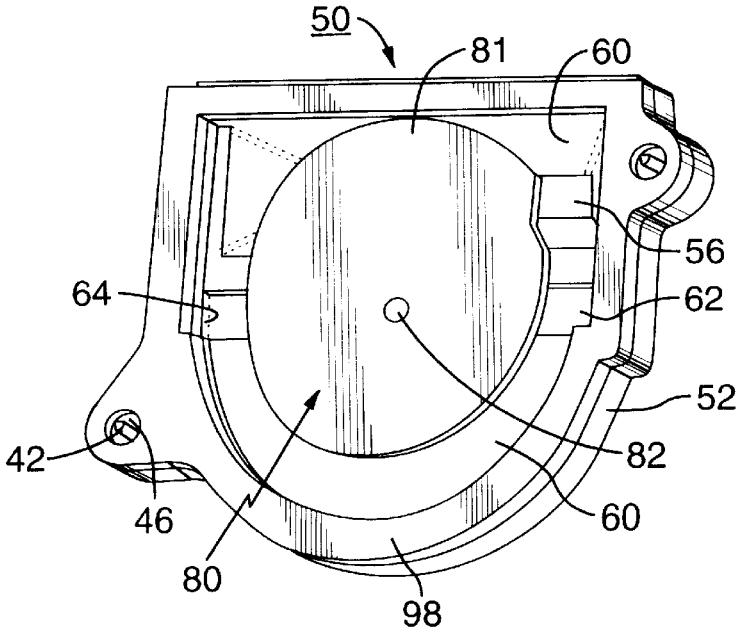

As best seen in FIGS. 4 and 5, the housing 50 has an inner surface 60 that forms part of the exterior wall 54. The surface 60 includes an elongated generally horizontally extending recessed slot 62. The side walls 52 further include, on an inner side thereof, two opposing recesses 64 adjacent the slot 62.

The diffuser assembly 40 further includes an elongate leaf spring 66 having two outwardly extending legs 68. The spring 66 has a central opening 70 that is aligned with the centralized opening 72 of the exterior wall 54 when the spring 66 is mounted within the housing 50. Spring 66 is mounted by having its end legs 68 positioned within the slot or recesses 64. This prevents the spring 66 from rotating. Further, spring 66 is located to extend adjacent the elongated slot 62 and is pulled back toward slot 62 when assembled.

The housing 50 further includes a dial diffuser 80 having an elongated shaft 82 that extends through the central openings 70 and 72 respectively in the spring 66 and the exterior wall 54 of the housing 50. The dial diffuser has a substantially circular disk shaped damper 81 that is drawn against the spring 66. The disk shaped damper 81 has a cut-out portion 84 that is rotatable with the shaft 82 to cover the first air flow opening 60 and thereby control be passage of air through the housing and into the fresh food compartment 12. It should be understood that the cut out portion 84 is shown as a cut into the disk damper 81 and may alternatively comprise one or more openings cut through the disk damper 81. The disk shaped damper 81 further includes projections 86 that project back toward the spring 68. The spring 68 also includes a projection 88 that projects towards the tabs or projections 86 of the damper 81 to rotatably locate the disk damper 81 relative to the spring 66.

The damper shaft 82 extends through the openings 70 and 72 so that a portion 90 of the shaft 82 extends beyond the exterior wall 54. The knob 32 is secured to the end of the shaft portion 90 to allow a user to rotate the shaft 82 and control the relative location of the diffuser disk damper 81 relative to the air inlet opening 36. The shaft extension 90 includes a recessed groove 92 used to secure the shaft 82 relative to the housing 50.

The shaft 82 is secured relative to the housing 50 by a locking member 94 secured to the shaft 90 in pressing relation through washer 96 to outside of exterior wall 54. The locking member 92 is an open spring like washer that fits into the groove 92 of the shaft extension 90. This holds the shaft 90 in tension in the housing between the locking member 94 and the biased leaf spring 66 without placing any tension or strain on the rear liner wall 28.

A gasket 98 is provided to seal the housing 50 with the rear liner wall 28 and minimize air flow losses that might result from an improper mounting of the housing 50 to the rear liner wall 28.

Certain preferred embodiments of the invention have been described in detail. From a reading of this disclosure, obvious modifications will be evident to those skilled in the art without departing from the spirit of the invention disclosed or from the scope of the appended claims.

What we claim is:

1. A diffuser assembly for use in a refrigerator having a liner wall with a first air flow opening therein, the diffuser assembly comprising:

a housing mounted to the liner wall and covering the first air flow opening, the housing including side walls and an exterior wall having a second air flow opening spaced from the liner wall by the side walls, the housing including an air flow passage extending through the housing between the first air flow opening and a second air flow opening for communicating air flow from the liner opening to the second air flow opening and into the refrigerator, and the exterior wall of the housing having a first centralized opening passing therethrough;

an elongate leaf spring secured in the housing adjacent the inner surface of the exterior wall for providing a spring bias away from the exterior wall, the leaf spring including a second centralized opening aligned with the first centralized opening of the exterior wall;

a dial diffuser having an elongate shaft extending through the first and second centralized openings with a shaft controlling portion extending beyond the exterior wall of the housing; the dial diffuser having a substantially circular disk shaped damper drawn against the leaf spring, the damper having a cut out portion and being rotatable with the shaft to control coverage area of the first air flow opening in the liner and control air flow through the housing; and, a locking member secured to the shaft extension portion adjacent to and in pressing relation with the exterior wall of the housing to hold the shaft under tension with the disc damper pulled against the biased leaf spring.

2. The diffuser assembly of claim 1 wherein the shaft extension portion has a recessed groove adjacent the exterior wall of the housing.

3. The diffuser assembly of claim 2 wherein an open spring lock washer is inserted into the recessed groove of the shaft extension portion and contacts the exterior wall of the housing.

4. The diffuser assembly of claim 1 wherein the first centralized opening passing through the exterior wall is tapered.

5. The diffuser assembly of claim 1 wherein the leaf spring includes a projection that projects towards the disk baffle and the disk baffle includes projections that project towards the leaf spring to rotatably locate the disk damper relative to the leaf spring.

6. The diffuser assembly of claim 1 further including a gasket between the side walls of the housing and the liner wall of the refrigerator.

7. The diffuser assembly of claim 1 wherein the housing is provided with mounting openings through which fasteners pass to mount the housing to the liner of the refrigerator.

8. A diffuser assembly for use in a refrigerator having a liner wall with a first air flow opening therein, the diffuser assembly comprising:

a housing mounted to the liner wall and covering the first air flow opening, the housing including side walls and an exterior wall having a second air flow opening spaced from the liner wall by the side walls, the housing including an air flow passage extending through the housing between the first air flow opening and a second air flow opening for communicating air flow from the liner opening to the second air flow opening and into the refrigerator, the exterior wall of the housing having a first centralized opening passing therethrough, and, the exterior wall including an inner surface with a recessed elongated slot;

an elongate leaf spring secured in the housing adjacent the inner surface along the recessed slot and adapted to be pulled toward the recessed slot to provide a spring bias away from the exterior wall, the leaf spring including a second centralized opening aligned with the first centralized opening of the exterior wall;

a dial diffuser having an elongate shaft extending through the first and second centralized openings with a shaft controlling portion extending beyond the exterior wall of the housing; the dial diffuser having a substantially circular disk shaped damper drawn against the leaf spring, the damper having a cut out portion and being rotatable with the shaft to control coverage area of the first air flow opening in the liner and control air flow through the housing; and, a locking member secured to the shaft extension portion adjacent to and in pressing relation with the exterior wall of the housing to hold the shaft under tension with the disc damper pulled against the biased leaf spring.

9. The diffuser assembly of claim 8 wherein the side walls of the housing include two opposing recesses adjacent the elongated slot and the elongated leaf spring includes outturned legs positioned within the side wall recesses to prevent rotation of the leaf spring about its second centralized opening.

10. The diffuser assembly of claim 9 wherein the shaft extension portion has a recessed groove adjacent the exterior wall of the housing.

11. The diffuser assembly of claim 10 wherein an open spring lock washer is inserted into the recessed groove of the shaft extension portion and contacts the exterior wall of the housing.

12. The diffuser assembly of claim 11 wherein the first centralized opening passing through the exterior wall is tapered.

13. The diffuser assembly of claim 11 wherein the leaf spring includes a projection that projects towards the disk baffle and the disk baffle includes projections that project towards the leaf spring to rotatably locate the disk damper relative to the leaf spring.

14. The diffuser assembly of claim 13 further including a gasket between the side walls of the housing and the liner wall of the refrigerator.

15. The diffuser assembly of claim 14 wherein the housing is provided with mounting openings through which fasteners pass to mount the housing to the liner of the refrigerator.

16. The diffuser assembly of claim 15 further including a control knob mounted to the end of the shaft extension portion.

* * * * *